United States Patent [19]

Muggli et al.

[11] 4,356,478

[45] Oct. 26, 1982

[54] EMPLOYING A SHAPE MEMORY ALLOY IN A FIRE ALARM TEMPERATURE SENSITIVE ELEMENT

[75] Inventors: Jürg Muggli, Männedorf; Peter Müller, Oetwil-am-See, both of Switzerland

[73] Assignee: Cerberus AG, Männedorf, Switzerland

[21] Appl. No.: 140,464

[22] Filed: Apr. 17, 1980

[30] Foreign Application Priority Data

May 21, 1979 [CH] Switzerland ..... 4719/79

[51] Int. Cl.[3] ..... G08B 17/06; H01H 37/60

[52] U.S. Cl. ..... 340/593; 337/140

[58] Field of Search ..... 340/593, 584, 594; 337/140

[56] References Cited

U.S. PATENT DOCUMENTS

| | | | |
|---|---|---|---|
| 2,886,804 | 5/1959 | Behrendt | 340/584 |
| 2,989,738 | 6/1961 | Taylor | 340/594 |
| 3,516,082 | 6/1970 | Cooper | 337/140 |
| 4,205,293 | 5/1980 | Melton et al. | 337/140 |

*Primary Examiner*—Glen R. Swann, III

*Attorney, Agent, or Firm*—Werner W. Kleeman

[57] ABSTRACT

A fire alarm is provided with a temperature sensitive element formed of a shape memory alloy, which following cold working, upon heating to a critical temperature, typically for instance about 70° C., returns to the original impressed shape and also retains this shape even after subsequent recooling. Due to the movement of the element there is triggered a self-holding alarm signal, either directly by closing contacts or indirectly. Resetting of the fire alarm can be accomplished by mechanically cold working the element, or by using two-way shape memory alloys through cooling to a lower temperature threshold which can be below room or ambient temperature. A further beneficial construction is realized by combining the arrangement with a different type of fire detection or sensing element, for instance by arranging a shape memory alloy element in a scattered radiation-smoke detector. Upon reaching a critical temperature, the shape memory alloy element moves into the radiation region, or when used in an ionization fire alarm, the shape memory alloy element screens the radioactive radiation source and reduces the ionic current. Suitable shape memory alloys are, by way of example, nickel 55/titanium 45, or nickel 45/titanium 45/copper 10.

12 Claims, 7 Drawing Figures

EMPLOYING A SHAPE MEMORY ALLOY IN A FIRE ALARM TEMPERATURE SENSITIVE ELEMENT

BACKGROUND OF THE INVENTION

The present invention relates to a new and improved construction of fire alarm which is of the type comprising a temperature sensitive element, which upon exceeding a predetermined critical temperature trips an alarm signal due to a change in its shape or configuration.

Heretofore known constructions of fire alarms, which utilize for alarm signaling purposes the phenomenon of exceeding a certain air or ambient temperature, which for instance can be in the order of between 50° C. and 100° C., preferably can lie in the region of about 70° C., contain different types of temperature sensitive elements which alter their shape in the presence of a temperature increase. For instance, in German Pat. No. 159,519 there are employed the length or volume elongation of contact thermometers or the bending of bimetallic elements composed of two layers possessing different thermal length elongation. In U.S. Pat. No. 3,122,728 it is known to utilize the bending of the wall of a chamber, in which there is encapsulated a gas or air, due to an increase in pressure accompanied by a temperature increase. The triggering of an alarm signal, in both of these cases, occurs either directly in that, due to the mechanical movement of the temperature sensitive element there is closed a contact, or indirectly in that there is carried out an electromagnetic or optical transmission. The alarm signal can be generated at or in the fire alarm itself and can consist of a visual or acoustical signal, or it can be constituted by an electrical signal, for instance, a current or voltage change, which is transmitted by means of connection lines to a central signal station.

What is disadvantageous with such state-of-the-art fire alarms is the fact that the change in shape of the temperature sensitive element is reversible, and thus, a triggered alarm signal is not self-holding, i.e. an alarm signal automatically resets as soon as the temperature again drops below the critical value, so that it is no longer possible to detect which fire alarm has responded. Moreover, when approaching the critical value, especially in the presence of temperature fluctuations or vibrations, there arise flutter or chatter phenomena, i.e. there is not insured for any positive contact making or closing. The result of this is that the contacts are rapidly worn and burned-off, and moreover, this is accompanied by the fact that tripping of the alarm signal is uncertain. The aforementioned types of fire alarms therefore do not fulfil the requisite operational safety or integrity which is expected of them. The deflection of the temperature sensitive element, at the neighborhood of the critical temperature, additionally, is only relatively slight and therefore only is accomplished with low force. It is for these reasons that there is required an exact adjustment or setting of such fire alarms to the desired critical temperature. Since, in particular, the setting does not possess any good long time stability, there is required a frequent post-setting, in order to afford the positive operational integrity which is strived for with such type equipment.

It has already been attempted to avoid individual ones of these drawbacks in that, there are employed temperature sensitive elements which do not mechanically change their shape, rather alter their electrical characteristics. For instance, there have become known in this technology fire alarms, utilizing as the sensor or feeler elements, temperature sensitive resistances or other temperature sensitive components, and there is exploited the change in the electrical properties or characteristics, for instance, the change in the resistance is used for triggering an alarm signal with the aid of an electronic evaluation circuit. This circuit can be designed such that it likewise only contains electrical switching elements for tripping the alarm signal, for instance, thyristors or electrical switches. With this technique it is possible to obtain positive giving of an alarm signal at a predetermined temperature, and specifically, in a self-holding fashion in a manner such that the alarm signal does not again automatically reset when the temperature drops. What is however disadvantageous with such prior art fire alarms working exclusively with electronic or electrical components, is that they always have an appreciable quiescent or rest current, even below the critical temperature. These fire alarms therefore are not suitable for use with complex or expanded fire alarm installations, wherein there are connected a large number of fire alarms in parallel at the same lines or conductors, since in this case the sum of the quiescent currents, even for only a few fire alarms, can reach a value corresponding to the order of magnitude of the alarm current of a single fire alarm, and thus, it is no longer possible to discriminate an alarm signal in a positive fashion from the quiescent currents of all of the fire alarms.

SUMMARY OF THE INVENTION

Therefore, with the foregoing in mind it is a primary object of the present invention to provide a new and improved construction of fire alarm which is not afflicted with the aforementioned drawbacks and limitations of the prior art proposals discussed above.

Another and more specific object of the present invention aims at overcoming the aforementioned drawbacks of heretofore known thermal fire alarms, and, in particular, providing a new and improved construction of fire alarm which, in a most simple manner and without using a multiplicity of components, is capable of tripping a self-holding alarm signal with improved operational reliability or security, and which alarm signal is not automatically reset in the presence of a temperature drop.

In keeping with the immediate preceding objective it is contemplated, according to a further object of the invention, to provide a fire alarm of the aforementioned type which displays operational integrity and is free of malfunction or disturbance throughout a longer time span, does not exhibit any wear phenomena, does not require frequent maintenance or adjustment operations, and retains a once selected critical temperature.

Still a further significant object of the present invention is directed to the provision of a new and improved construction of fire alarm which is relatively simple in design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the fire alarm of the present development is manifested by the features that the temperature sensitive element comprises a shape memory alloy which, upon exceeding the critical temperature, returns back into its impressed shape.

These so-called "shape memory alloys", which may be metals of the type described by way of example and not limitation in U.S. Pat. No. 3,174,851, U.S. Pat. No. 3,403,238, German Pat. No. 1,288,363, German Pat. No. 1,588,715 and the well known publication Journal of Applied Physics 36, pages 3232 et seq (1965), possess the characteristic that when fabricated at elevated temperature they store or memorize their selected geometric shape. After cooling of the element, below a critical temperature governed by the material from which the element is formed, the element can be mechanically worked or shaped. Now if the temperature again is raised to the critical temperature, then the material again assumes its original shape, independent of the manner in which it was previously cold worked. Up to a certain deformation the change in shape is therefore completely freely selectable.

Now in the article authored by W. J. Buehler and W. B. Cross, in the publication "Wire Journal", June 1969, appearing at pages 41 to 49, and in the article authored by K. N. Melton and O. Mercier in the German language publication entitled "Material und Technik", volume 6 (1978), No. 2, appearing at pages 59 to 66, there have been compilated the properties of such shape memory alloys and the composition of suitable shape memory alloys. As a general rule, these shape memory alloys comprise metals exhibiting a martensite transformation. Particularly suitable shape memory alloys are nickel/titanium alloys, also known under the commercial designation "NITINOL", or alloys formed of copper, zinc and aluminum. Shape memory alloys which have been found to be particularly advantageous for use in the environment of fire alarms are nickel/titanium alloys having an additive of other alloying elements, predominantly copper, for instance for use with a critical temperature of about 70° C. there can be beneficially employed the alloys Ni55/Ti45 or Ni45/Ti45/CulO.

For most fields of application in the fire alarm technology, there have been found to be practically useful shape memory alloys which operate according to the one-way principle. Here, the feeler or sensor element, upon attaining the critical temperature, again deforms into its original shape. This shape remains and causes triggering of a self-holding alarm signal, which only can be eliminated through mechanical reshaping of the feeler element. For special fields of application there also can be advantageously employed however shape memory alloys which operate according to the two-way principle. These alloys have the characteristic that following cold working, upon heating to the critical temperature they do not return back into their starting shape. Now if the temperature again drops, then they change their shape upon reaching another lower threshold in a manner which is analogous to the shape realized during cold working. A fire alarm equipped with such type feeler or sensor element therefore can again be reset by cooling to a lower threshold temperature, after it has responded following reaching of the upper critical temperature. Such hysteresis-type behavior is desirable in the event there are intended fire alarms having two different threshold values or thresholds. In this regard, it is advantageous to select the lower threshold between room temperature and the upper critical temperature. However, it also can be advantageous to select the lower threshold below room or ambient temperature. Such type fire alarm has the property that after it has once responded it can be reset by cooling below the lower threshold, without the need to perform any mechanical action. This resetting action can be obtained, for instance, through the use of a suitable spray agent which can be sprayed into the detector and causes, by virtue of the cold effect caused by evaporation, a cooling below the room or ambient temperature.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 5*b* is a schematic bottom view of the arrangement of FIG. 5*a.

DETAILED DESCRIPTION OF THE PREFERRED EMBODIMENTS

Figure 1:
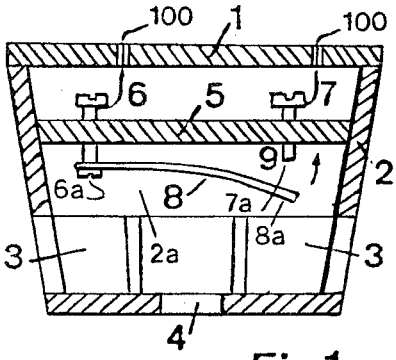
FIG. 1 is a schematic sectional view of a thermal fire alarm working with direct contact making or closing of the contact means.

Describing now the drawings, it is to be understood that only enough of the construction of the different embodiments of fire alarms, designed according to the invention, have been shown in order to preserve clarity and simplification of the illustration and as needed for one skilled in the art to readily understand the underlying principles and concepts of the present development. As will be evident from the disclosure the teachings of the invention can be beneficially employed with the most various constructions and types of fire alarms and related circuitry. Turning attention now to FIG. 1, there is shown in sectional view a first embodiment of fire alarm which contains a housing 2 mounted upon a base plate 1. The housing 2 is provided at its lower portion with relatively large openings 3 and 4 for the entry of air into the interior or internal compartment 2*a* of the housing 2. Within the housing 2 there is provided a mounting plate 5 or equivalent structure, supporting two electrical connections 6 and 7, from which lead electrical lines or conductors, generally indicated by reference character 100, if desired with the aid of a socket, to a not particularly illustrated but conventional signaling device. At the lower end 6*a* of the one connection or terminal means 6 there is attached a strip element 8 formed of a shape memory alloy in a manner such that its other end 8*a* is located near to the lower end 7*a* of the other connection of terminal means 7 which is structured as a counter contact 9. The dimensions of the strip element 8 or equivalent structure are in no way critical and, purely by way of example and not limitation, can amount to for instance 0.5 millimeters thickness by 3 millimeters width by 35 millimeters length. The strip element 8 can be fabricated from any one of the previously discussed shape memory alloys, preferably is fabricated from a titanium/nickel alloy having copper additive. The alloy composition is chosen such that its critical temperature corresponds to the desired response temperature of the fire alarm. This can be between, for instance, 50° C. and 100° C., preferably at around 70° C. During its manufacture the strip element 8 is shaped at elevated temperature such that it initially has an extended or elongated configuration. During assembly of the strip element 8 in the fire alarm, in such configuration, it short-circuits the connections or terminals 6 and 7. In order to render the fire alarm operationally reliable the strip element 8 is shaped or worked in cold condition such that it lifts-off of the counter contact 9. Depending upon the alloy composition, the change in shape can amount to approximately 8% if there is desired a one or single-way shape memory effect, or 2% when utilizing the hysteresis or the two-way effect heretofore discussed. Now as soon as the room temperature increases, for instance due to a fire breaking-out and hot air penetrates into the interior or inner chamber 2*a* of the housing 2 of the fire alarm, the strip element 8 heats-up. In contrast to bimetallic elements, the strip element 8 however does not first bend. Only upon exceeding the predetermined critical temperature, for instance upon exceeding 70° C., does there occur a relatively rapid change in shape, at which the strip element 8 again assumes its original extended configuration or shape and now comes into contact with the counter contact 9. By means of the lines or conductors 100 which are secured to the connections or terminals 6 and 7 there is then triggered an alarm signal. Due to the inherent heating of the strip element 8, by the current which flows through such strip element, there is insured a particularly positive contact making or closing.

What is advantageous with this design is that the contact making and the tripping of the alarm signal occur relatively rapidly within a narrow temperature range. There is beneficially avoided the contact chatter or flutter which is caused when contact closing is not accomplished as occurs with prior art fire alarms. Additionally, there is realized the advantage that the force exerted upon the contacts, here the strip end 8*a* and counter contact 9, is appreciably greater than in the case of fire alarms working with other types of temperature sensitive mechanically movable elements. Also of advantage is the fact that, even following a subsequent temperature return, i.e. temperature drop, the shape memory alloy strip element 8 or the like retains its shape and does not again lift-off of the counter contact 9. The alarm signal which has been tripped by the fire alarm is also self-holding. The fire alarm now can be reset in that the strip element 8 is again deformed or shaped in its cooled condition. This resetting of the fire alarm can be accomplished mechanically by hand, when using a shape memory alloy operating according to the one-way-shape memory effect. However, it also can be advantageous to employ an alloy which operates according to the two-way-shape memory effect, in other words which upon falling below a lower temperature threshold again returns or deforms, so that the strip element 8 again raises-off the counter contact 9. This lower threshold can be chosen that it is above room temperature, so that such fire alarm automatically again resets following dropping of the air or ambient temperature. Instead of using this design of fire alarm, it is also possible to select the shape memory alloy such that the lower temperature threshold is below room temperature. Such type fire alarm does not automatically reset, but however through the employment of a suitable heat removal agent, for instance by cooling the shape memory alloy element with a suitable spray agent, which can be sprayed into the interior 2*a* of the housing 2, it is possible to reset the fire alarm.

Figure 2:
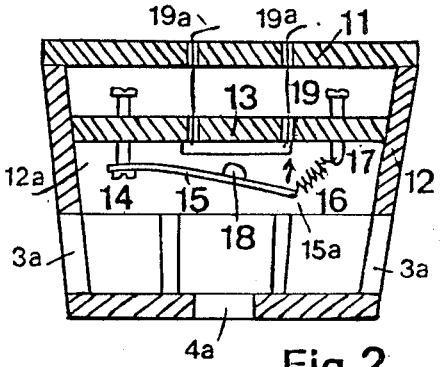
FIG. 2 is a schematic sectional view of a thermal fire alarm working with indirect contact making.

FIG. 2 illustrates a further embodiment of a thermal fire alarm containing a base plate 11 and a housing 12, mounted upon the base plate 11, wherein the housing 12 also has air entry or inlet openings 3*a*, 4*a*. Within the internal chamber or interior 12*a* of the housing 12 there is again provided a mounting plate 13. Secured to the mounting plate 13, by means of a connection or attachment element 14, is a shape memory alloy element 15, here shown in the form of a strip, wire or pin or equivalent structure, formed of a suitable shape memory alloy. The free end 15*a* of the shape memory alloy element 15 is connected, by means of a coil or helical spring 16, with an oppositely situated attachment pin 17, such that the system composed of the shape memory alloy element 15 and the coil or helical spring 16, only can have two stable positions, i.e. this system exhibits a so-called snap effect.

The shape memory alloy element 15 is also in this case shaped or worked such that it is in an extended configuration in its starting condition, i.e. assumes the upper stable position. During the cold working operation the element 15 is now deformed to such an extent that it assumes the other lower stable position. In the presence of a temperature increase and upon reaching the critical temperature, the element 15 now suddenly snaps back, with the result that a pin 18 or equivalent structure, mounted at the shape memory alloy element 15, presses upon a pressure sensitive switching element 19. As to the pressure sensitive switching element 19 the same can be constituted, for instance, by a microswitch, a pressure sensitive elastomer or a light guide or conductor, the transmission properties of which alter when acted upon by pressure. By means of both of the electrical connections, here generally indicated by reference character 19*a*, of the pressure sensitive switching element 19 it is again possible to trigger an alarm signal. What is particularly advantageous with this design of fire alarm is that there can be avoided open contacts, and thus, there is insured for positive contact making or closing with additionally augmented switching force.

With the embodiment of fire alarm illustrated in FIG. 3, there is again provided a housing 22, secured to a base plate 21. The housing 22 is provided with a support or mounting plate 23. With this design of fire alarm the temperature sensitive element, formed of a shape memory alloy, comprises a coil or helical spring 24. Here, the one end 25 of the helical spring 24 is secured to the underside or lower portion 22*a* of the housing 22, whereas the other spring end 26 is fixedly connected with a movable plunger or punch element 27. The plunger 27 piercingly extends through a respective central opening 23*a* and 22*b* of the mounting plate 23 and the housing lower portion 22*a*. According to one embodiment of the invention, there is used a helical spring 24 having five coils or windings formed of one millimeter thick Ni55/Ti45-wire of 16 millimeters diameter. Mounted at the base or mounting plate 23, at the region of the movable plunger 27, is a magnetically actuatable switching element 28. The switching element 28 can be designed, by way of example, as a protective gas contact switch, also referred to commonly in the electrical art as Reed relay, or can be a semiconductor magnetic probe, also referred to conventionally in the art as a Hall switch. At the upper end 27*a* of the movable plunger 27 there is mounted a permanent magnet 29, which, for instance, can be constructed as an AlNiCo-magnet (aluminum-nickel-cobalt magnet) or as a SmCo-magnet (samarium-cobalt magnet). At the lower end 27*b* of the plunger 27 there is provided a substantially ring-shaped or annular marker 30 formed of any suitable signaling dye or color, for instance a red dye.

The temperature sensitive helical spring 24, constituting the shape memory alloy element, is structured such that, following the cold working or shaping, it upwardly urges or presses the plunger 27. The permanent magnet 29 or equivalent structure is selected and arranged, in relation to the magnetically actuatable switch 28, in a manner such that its magnetic field, in this position of the plunger 27, is not adequate in order to close the magnetically actuatable switching element 28 which defines contact means. Now if the ambient or air temperature, and along therewith the temperature of the helical spring 24, attains the critical temperature, then the helical spring 24 again assumes its original shape which it had prior to the cold working, i.e. it contracts and downwardly draws the plunger 27. Hence, the switch or contact means 28 arrives at the effective region of the permanent magnet 29 which closes the contacts 28*a* of the switch or contact means 28. Consequently, there is now triggered an alarm signal at the lines or conductors, here generally indicated by reference character 110, which are connected with the terminals 28*b* of the switch means 28. Through the provision of parallel arranged soft iron parts it is therefore possible to achieve a magnetic snap effect. At the same time the lower end 27*b* of the plunger 27, which as it will be recalled is provided with the colored or dyed signaling or marker portion 30, protrudes out of the central housing opening 22*b*, and therefore indicates to an observer that the related fire alarm has responded. After cooling has occurred the plunger 27 can again be manually pushed back into the housing 22, whereby the helical spring 24 again is cold worked. Hence, the fire alarm is again operationally ready to perform its fire detection function.

Figure 3:
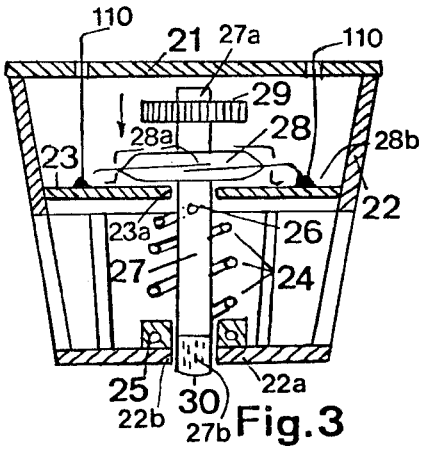
FIG. 3 illustrates in schematic sectional view a thermal fire alarm working with magnetic contact making.

The described embodiment of FIG. 3 is associated with the advantage that there are not provided any open accessible contacts, which during the course of time, could become contaminated or, upon actuation, could burn-off. A fire alarm or detector equipped with a magnetically actuated switch, especially a Reed relay, of the type under discussion, is capable of reliably functioning over a longer time span, even after having been activated a number of times, in relation to state-of-the-art thermal fire alarms. Apart from the foregoing, this design of fire alarm possesses the further notable advantages that notwithstanding its most simple design, a self-holding alarm signal can be displayed both at the fire alarm itself and also by means of lines or conductors at a remotely situated location or site, and in the non-responsive condition of the fire alarm there is no current flow. Therefore, such fire alarms can be connected in larger numbers in a parallel circuit configuration, and also, can be combined with manual alarm sensors or other fire alarms, which likewise do not produce any quiescent or rest current.

With the heretofore described exemplary embodiments the signaling of the alarm is accomplished by closing contacts due to the movement of the shape memory alloy element, either directly or indirectly. Frequently, it is however necessary to rely upon other phenomena which accompany a fire, for instance the appearance of smoke or combustion aerosols in order to trigger an alarm signal. In these instances, it is advantageous that the temperature sensitive element, composed of a shape memory alloy, be capable of combination with a different type of fire sensor or feeler which responds to another fire phenomena. Hence, it is advantageous to use a common switching element, both for the temperature sensitive element and also for the other feeler or sensor element. It is possible to obtain particularly simple and reliable constructions if, the temperature sensitive element is constructed and arranged such that when it returns to its former shape, upon reaching the critical temperature, it triggers the same effect as the other fire feeler or sensor.

Figure 4:
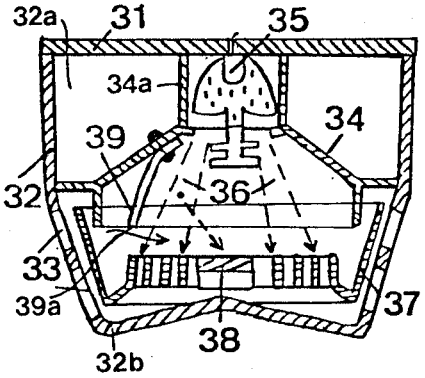
FIG. 4 is a schematic sectional view of an optical smoke detector equipped with an additional thermal alarm triggering arrangement.

Now in FIG. 4 there is illustrated an optical smoke detector of the aforementioned type. A fire alarm housing is attached to a base or mounting plate 31. The housing 22 possesses air inlet or entry openings 33, and in the internal space or interior 32*a* of the housing or housing means 32 there is arranged a substantially cup or bowl-shaped support portion or element 34. At the upper central region 34*a* of the support portion or element 34 there is arranged a suitable radiation source 35 which, with the aid of a related optical system, produces a conical ring-shaped radiation region 36, such as for instance has been disclosed in Swiss Pat. No. 592,932; also relevant in this respect is U.S. Pat. No. 4,175,865, granted Nov. 27, 1979, and U.S. Pat. No. 4,181,439, granted Jan. 1, 1980. Within the lower portion 32*b* of the housing 32 there is mounted a screening or baffle element 37, which screens the housing interior 32*a* against direct incidence of light, but however enables the entry of the ambient air along a tortious path. At the central portion of the screening or baffle element 37 there is arranged a suitable radiation receiver 38, here shown as a photoelectric radiation receiver, which normally is located externally of the conical ring-shaped radiation region 6, as is known in this technology and from the previously mentioned patents. If, however, air containing smoke or combustion particles enters into the housing interior or inner chamber 32*a*, then radiation is scattered at the smoke particles, which are located in the radiation region 36, and now the radiation receiver 38 is impinged by such scattered radiation. As soon as the intensity of this scattered radiation has exceeded a certain predetermined value or threshold, then by means of a not particularly illustrated but conventional circuit there is tripped an alarm signal. In addition to the aforedescribed structure which, as stated, is well known in this technology from prior art optical scattered radiation smoke detectors or alarms, there is also provided at the bowl-shaped support element 34 a temperature sensitive element 39 formed of a suitable shape memory alloy. This temperature sensitive element 39 is constructed and mounted, in relation to the radiation region 36, in a manner such that in its cold worked condition it is located completely externally of this region, in other words is not impinged by the direct radiation of the radiation source 35. Now if however the temperature exceeds the critical temperature of the employed shape memory alloy, then the shape memory alloy element 39 again assumes the originally impressed shape and moves with its free end 39*a* into the radiation region 36. The direct radiation emanating from the radiation source 35, which impinges at the free end 39*a* of the shape memory alloy element 39, is thus reflected and scattered, and part of this radiation impinges upon the radiation receiver 38. The radiation receiver 38 is therefore affected in the same manner as the scattered radiation attributable to the smoke particles located in the radiation region 36. Upon exceeding the selected critical temperature, by virtue of the change in shape of the temperature sensitive element 39, there is triggered in the same fashion an alarm signal as if smoke particles producing scattered radiation were present in the radiation region 36.

Instead of utilizing the concepts of the invention in conjunction with a scattered light smoke detector, it is also possible to use the same with a radiation extinction fire alarm, wherein the attenuation or weakening of the radiation by the smoke or combustion particles at a measuring path is employed for triggering an alarm signal. In this case, the shape memory alloy element is constructed such that, upon reaching the critical temperature, it pivots or otherwise moves into the region of the measuring path and likewise causes radiation attenuation.

Figure 5A:
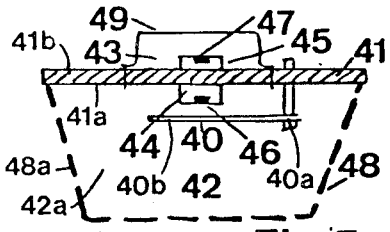
FIG. 5*a* is a schematic view of an ionization fire alarm or smoke detector equipped with an additional thermal alarm triggering device.
Figure 5B:
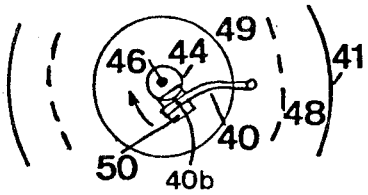
Figure 6:
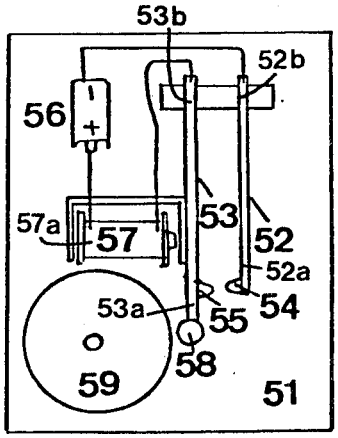
* and FIG. 6 schematically illustrates an autonomous fire alarm.

Continuing, in FIGS. 5*a* and 5*b* there is illustrated an ionization smoke detector comprising a base plate 41, at the underside or bottom surface 41*a* of which there is mounted a conventional ionization measuring chamber 42 and at the top surface 41*b* of which there is supported a reference ionization chamber or compartment 43. At the center of the base plate 41, at both of the sides or faces 41*a* and 41*b* thereof, there is mounted in each case a respective intermediate electrode 44 and 45 for the ionization measuring chamber 42 and the reference ionization chamber 43. The intermediate electrodes 44 and 45 each carry a respective radio-active substance 46 and 47, as is well known in the ionization fire alarm technology, by means of which the air in both of the chambers 42 and 43 is ionized. As the counter electrode for both of the ionization chambers 42 and 43 there can be used, for instance, the grid-shaped housing 48 of the ionization measuring chamber 42 and the air impervious housing 49 of the reference ionization chamber 43. Suitable exemplary constructions of such ionization fire alarms and associated evaluation circuits have been disclosed, for instance, in Swiss Pat. Nos. 486,082 and 489,070.

The function of such ionization smoke detectors is predicated upon the fact that smoke particles or combustion aerosols, which have penetrated into the ionization measuring chamber 42, reduce the ionic current which flows between the intermediate electrode 44 and the wall 48*a* of the housing 48 serving as the counter electrode. This current reduction is utilized, in known manner, for triggering an alarm signal with the aid of a related evaluation circuit.

Additionally, by reverting further to FIGS. 5*a* and 5*b*, it will be seen that there is utilized with the exemplary embodiment of ionization smoke detector a temperature sensitive element 40 formed of a suitable shape memory alloy as herein disclosed, the one end 40*a* of which is secured, in any appropriate manner, to the base or mounting plate 41. The temperature sensitive shape memory alloy element 40 is mounted such that in the cold worked condition it does not, or at most only slightly, influences the radio-active radiation which emanates from the radiation source 46. Now if, however, there is exceeded the critical temperature of the employed shape memory alloy, then the free end 40*b* of the temperature sensitive element 40 moves such as to assume its originally impressed position or shape. Consequently, the tab or flag 50 or equivalent structure, mounted at this free end 40*b* of the temperature sensitive element 40, moves across the radio-active source 46 and for the most part screens its emitted radio-active radiation. As a consequence thereof, the ionic current which flows between the intermediate electrode 44 and the counter electrode defined by the housing wall 48*a* of the housing 48 is reduced, in the same manner as if smoke or combustion aerosols have penetrated into the interior or internal compartment 42*a* of the ionization measuring chamber 42. Hence, upon exceeding the critical temperature there likewise is triggered by means of the same conventional evaluation circuit an alarm signal.

A modification which deviates only slightly from the above-described exemplary embodiment, utilizes the temperature sensitive element 40 as the support or carrier for a positionally alterable electrode, in order to influence, independent of the radiation source 46, the electrical field directly in a manner such that there arises the desired change in current.

With the constructions of fire alarms illustrated by way of example in FIGS. 4, 5*a* and 5*b*, it is possible to trigger a fire alarm signal in a simple manner and positively without the use of an additional evaluation circuit, when there arise different types of combustion or fire phenomena.

FIG. 4 illustrates an autonomous fire alarm having its own voltage supply, which need not be connected by means of lines or conductors to a central signal station. Such fire alarms are employed for intance in domestic applications, typically as residential fire alarms in order to protect a single object or dwelling. The illustrated fire alarm operates in accordance with the known principles of an electrical bell having a Wagner manner. In particular, it will be seen that upon a support or carrier plate 51 there is clamped or otherwise affixed at one end a respective rigid contact support 52 and an elastic, oscillatable contact support 53. The free ends or end regions 52*a* and 53*a* of the contact supports 52 and 53, respectively, each carry a related contact 54 and 55. The fixed ends 52*b* and 53*b* of both of these contact supports 52 and 53 are interconnected by means of a suitable power supply, here shown as a battery 56 and an electromagnetic coil 57. The elastic contact support 53 is arranged such that it is attracted by the electromagnetic means or electromagnetic coil 57, as soon as a current flows through its coil or windings, generally indicated by reference character 57*a*. When this occurs then a hammer or knocker element 58, provided at the free end 53*a* of the elastic contact support 53, strikes against a bell 59 or equivalent structure.

According to the invention the rigid contact support 52 is fabricated from a suitable shape memory alloy and mounted and cold worked such that both of the contacts 54 and 55 do not contact one another at room or ambient temperature. If, however, the temperature rises, in the presence of a fire, to the critical temperature, then the rigid contact support 52 deforms until both of the contacts 54 and 55 touch one another and a current flows through the electromagnetic means or electromagnetic coil means 57. Hence, the elastic contact support 53 is attracted by the electromagnetic means 57, the hammer 58 impacts against the bell 59 and the contacts 54 and 55 again open, so that the current flow is interrupted, the elastic contact support 53 springs back until the contacts 54 and 55 again touch one another. Thereafter, the described procedure periodically repeats. Turning off of the bell or alarm can be accomplished, in this case, only by the reshaping of the rigid contact support 52 in its cold condition. The degree of the change in shape is not critical in any manner, i.e. the fire alarm functions in an operationally reliable manner over longer time spans without the need for an exact post-adjustment.

It is here remarked that the invention is not limited to the described exemplary embodiments employing a temperature sensitive element formed of a shape memory alloy in a fire alarm having a further fire sensor or feeler element. The concepts of the invention can also be utilized in conjunction with other fire protection equipment, wherein, upon shaping back an element formed of a shape memory alloy, there can be triggered in an indirect manner an alarm signal. As an example there is mentioned the possibility of indirectly tripping an alarm signal in that, the temperature sensitive element, upon exceeding the critical temperature, initially activates a control for countering the situation where a fire arises, for instance an emergency exit or smoke withdrawal valve means, or closes a fire door, with the result that then contacts for tripping the alarm are then closed or opened.

The use of a temperature sensitive element formed of a shape memory alloy in the environment of a fire alarm, also is associated with the advantage that it is possible to obtain, with minimum expenditure, a positive self-holding alarm signal upon reaching a critical temperature, without the need to use components which must be designed and fabricated with narrow tolerances and require an exact adjustment. This type of construction of fire alarm therefore exhibits increased functional security over longer operating times, and equally, has the advantage that it is less prone to malfunction or disturbances.

While there are shown and described present preferred embodiments of the invention, it is to be distinctly understood that the invention is not limited thereto, but may be otherwise variously embodied and practiced within the scope of the following claims.

What we claim is:

1. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

said shape memory alloy possessing a hysteresis behavior;

said shape memory alloy having a lower temperature threshold, different from the critical temperature at which the shape memory alloy element returns to its originally impressed shape; and said shape memory alloy element, upon cooling to such lower temperature threshold, again altering its shape back at least approximately into an altered shape which it possessed due to a prior cold working of said shape memory alloy element.

2. The improvement as defined in claim 1, wherein:

said shape memory alloy contains nickel, titanium, and at least one further metal.

3. The improvement as defined in claim 2, wherein:

said at least one further metal comprises copper.

4. The fire alarm as defined in claim 1, wherein:

said shape memory alloy possesses a critical temperature in a range between about 50° C. and 100° C.

5. The improvement as defined in claim 4, wherein:

said critical temperature is about 70° C.

6. The improvement as defined in claim 1, wherein:

said lower temperature threshold is below normal room temperature.

7. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

said temperature sensitive shape memory alloy element having opposed ends;

means for securing one end of said temperature sensitive element and with the other end defining a free end;

said temperature sensitive element being movable between two predetermined positions;

spring means for supporting said free end of said shape memory alloy element;

said spring means applying a force upon said temperature sensitive element to enable said temperature sensitive element to move with a snap action between said two predetermined positions defining two stable positions; and said shape memory alloy element upon exceeding the critical temperature shifting with said snap action from the one stable position into the other stable position.

8. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

magnetically actuatable switch means;

permanent magnet means with which there is operatively associated said temperature sensitive shape memory alloy element;

said permanent magnet means being moved, upon said shape memory alloy's reaching the critical temperature, such that said magnetically actuable switch means is activated.

9. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

radiation source means for emitting radiation in a predetermined radiation region;

radiation receiver means impinged by radiation which is scattered at said radiation region; and said temperature sensitive shape memory alloy element being arranged such that during return thereof to its originally impressed shape, upon exceeding the critical temperature, said shape memory alloy element moves into the radiation region and radiation which is reflected and scattered at parts of the shape memory alloy element impinges upon said radiation receiver means.

10. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

radiation source means;

radiation receiver means for receiving radiation emitted by said radiation source means;

said emitted radiation being attenuated in the presence of smoke entering the fire alarm; and said temperature sensitive shape memory alloy element being structured and arranged such that during return of the shape thereof to its originally impressed shape it attenuates the radiation which is emitted onto the radiation receiver means.

11. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

means defining an ionization chamber containing a radioactive material providing a radioactive radiation source;

two electrodes having therebetween an intermediate space;

said ionization chamber ionizing the intermediate space between said two electrodes; and said temperature sensitive shape memory alloy being structured and arranged such that upon exceeding the critical temperature thereof, during the return to its originally impressed shape, the radiation of the radioactive radiation source is at least partially screened and there is altered an ionic current flowing between said two electrodes.

12. In a fire alarm containing a temperature sensitive element, which upon exceeding a predetermined critical temperature triggers an alarm signal due to a change in the shape of said temperature sensitive element, the improvement which comprises:

said temperature sensitive element containing a shape memory alloy which, upon exceeding the critical temperature, returns into its originally impressed shape;

means defining an ionization chamber containing a radioactive substance defining a radiation source;

two electrodes provided for said ionization chamber;

an electrical field prevailing between said two electrodes; and said temperature sensitive shape memory alloy element being structured and arranged such that one of the electrodes comprises said shape memory alloy element which, during reshaping thereof, changes its position thereby altering the electrical field.

* * * * *